United States Patent [19]

Gershov et al.

[11] Patent Number: 4,718,409

[45] Date of Patent: Jan. 12, 1988

[54] BODY CARE APPLICATOR

[76] Inventors: Uri Gershov, 40 Wallingford Rd., Brighton, Mass. 02135; Edward Marinow; Eleanor Marinow, both of 186 Sundown Trail, Williamsville, N.Y. 14221

[21] Appl. No.: 919,634

[22] Filed: Oct. 16, 1986

[51] Int. Cl.[4] ..... A61H 7/00

[52] U.S. Cl. ..... 128/62 R; 128/57; 128/63; 15/222

[58] Field of Search ..... 128/62 R, 57, 58, 60, 128/61, 63, 67; 15/105, 106, 110, 222

[56] References Cited

U.S. PATENT DOCUMENTS

| | | | |
|---|---|---|---|
| 1,106,493 | 8/1914 | Catlin | 128/62 R |
| 1,746,075 | 2/1930 | Edwards | 15/222 |
| 2,168,975 | 8/1939 | Clarke | 128/62 R |
| 3,814,085 | 6/1974 | Kupchinski | 128/57 |
| 3,957,039 | 6/1976 | Ehren | 128/58 |
| 4,023,567 | 6/1977 | Wessel | 15/110 X |
| 4,052,982 | 10/1977 | Ozeryansky | 128/57 |
| 4,510,640 | 4/1985 | Omori | 15/105 X |

FOREIGN PATENT DOCUMENTS

| | | | |
|---|---|---|---|
| 1766539 | 8/1971 | Fed. Rep. of Germany | 128/62 R |
| 17056 | 12/1898 | Switzerland | 15/222 |
| 10674 | of 1902 | United Kingdom | 4/26 |

*Primary Examiner*—Charles A. Pearson
*Assistant Examiner*—Joseph McCarthy
*Attorney, Agent, or Firm*—E. Herbert Liss

[57] ABSTRACT

A body care appliance fixed to a backing element is removably and replaceably mounted on a human body encircling frame of flexible plastic tubular material. The frame is separable at a junction. A segment may be inserted at the junction to enlarge the frame. The backing element chordally straddles the frame. A plurality of units having a body care appliance fixed to a backing element are provided which enable the use of the invention for diverse self-treatment body care functions at the dorsal area of the body such as scrubbing, massaging, application of a heating pad and application of body care creams and lotions.

7 Claims, 7 Drawing Figures

BODY CARE APPLICATOR

BACKGROUND OF THE INVENTION

The present invention relates to an improved body care applicator assembly for self-treatment which can interchangeably accomodate a plurality of diverse types of body treatment appliances.

Self access to the dorsal area of the human body is awkward; the human back is difficult to reach with known implements such as back scrubbers, medicine, cream and lotion applicators, heating pads and massaging devices. Some of the known devices of this kind are equipped with long handles having various curvatures which relieve the difficulty somewhat. Nevertheless, certain areas of the back remain difficult and in some instances impossible to access. For persons with arthritis, muscular or other infirmities the difficulties are immensely magnified rendering self-treatment in many cases hopeless. The presently available specially designed devices generally provide only for a single function such as a brush or massager, etc. These designs accomplish very little in effecting convenience and comfort in the use of such devices.

The prior art discloses body encircling devices for facilitating self-access to dorsal areas of the body. Among these are the Roller Massager disclosed in U.S. Pat. No. 3,957,039 to Fritz A. Ehrens, issued May 18, 1976 and a Massaging Device disclosed in U.S. Pat. No. 3,814,085 to Edward C. Kupchinski, issued June 4, 1984. Both of the above-mentioned devices are single function devices with permanently affixed applicators.

SUMMARY OF THE INVENTION

A self-treatment body care assembly for accessing the dorsal area of the torso comprises a frame which extends at least partially and, preferably, entirely about the body and supports, alternatively, diverse body applicators. A plurality of different types of applicators may be provided including, for example, a scrubber, a massager, a heating pad and a medicine applicator. The applicators may be mounted on a rigid backing element which includes slots or other suitable frame engaging clamping means at its ends for retaining the applicators in position on the frame.

The frame may be separable and of reduced cross section at an end of the separable portion to telescopically accomodate a segment. Insertion or removal of a segment provides adjustability for accomodating various sized persons.

It is one object of the present invention to provide an improved self-treatment device for facilitating access to the dorsal area of the body and which utilizes, alternatively, diverse types of body treatment appliances.

Another object of the invention is to provide an improved self-treatment device which provides access to the dorsal area, which utilizes interchangeable applicators to be employed for a plurality of functions and which is adjustable to accomodate bodies of different sizes.

Other objects and advantages of the invention will be apparent from the following detailed description taken in connection with the accompanying drawings.

DETAILED DESCRIPTION OF THE INVENTION

Figure 1:
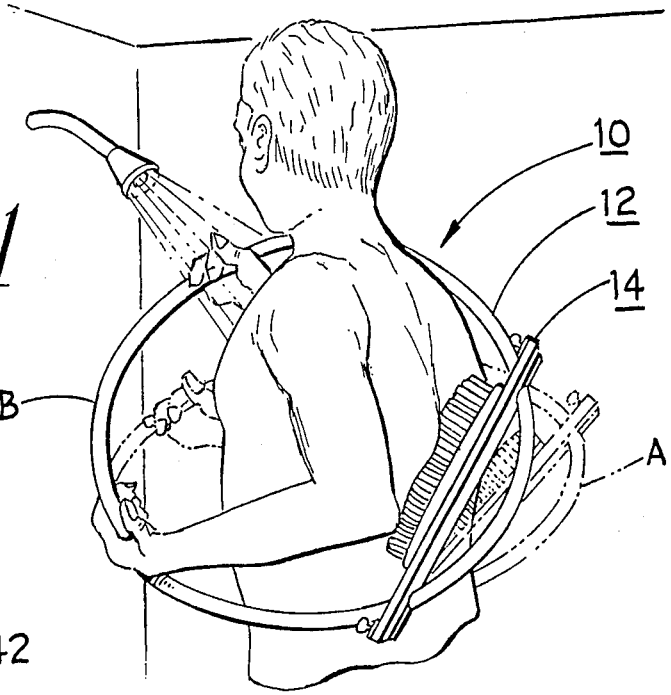
FIG. 1 is a diagram in perspective illustrating the invention in use.
Figure 3:
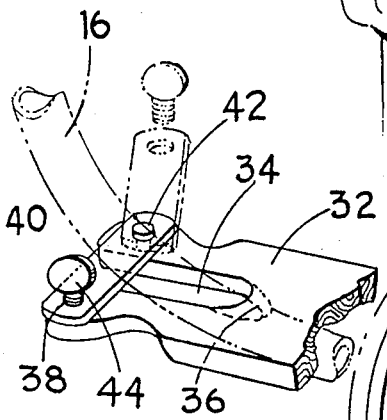
FIG. 3 is a fragmentary perspective view of an applicator backing element illustrating the clamping means.

Referring now to the drawings, self-treatment body applicator apparatus 10 is illustrated comprising a frame assembly 12 and a body applicator assembly 14 exemplified by scrubbing brush assembly **14*a*** removably mounted thereon.

The frame assembly 12 is illustrated by way of example comprising a closed circular frame element 16 of tubular plastic material. The frame element 16 is separable as shown at junction 18. At the junction 18 one end 20 includes a reduced diameter projection 22 which is telescopically and frictionally engagable within the adjacent end 24. A segment 26 of similar material and cross section as frame element 16 may be provided for insertion between the ends 24 and 20 of the frame element 16 to render the frame element 16 adjustable whereby it can accomodate persons of different sizes. One end 28 of the segment 26 is of reduced cross section so as to be frictionally engageable with the end 24 of frame element 16 while the other end of segment 26 is dimensioned to frictionally engage projection 22 at the reduced cross section end 20 of frame element 16. The frame element 16 is of such flexibility as to accomodate, without kinking, the distortion resulting from insertion of segment 26 (See broken line in FIG. 2).

Figure 2:
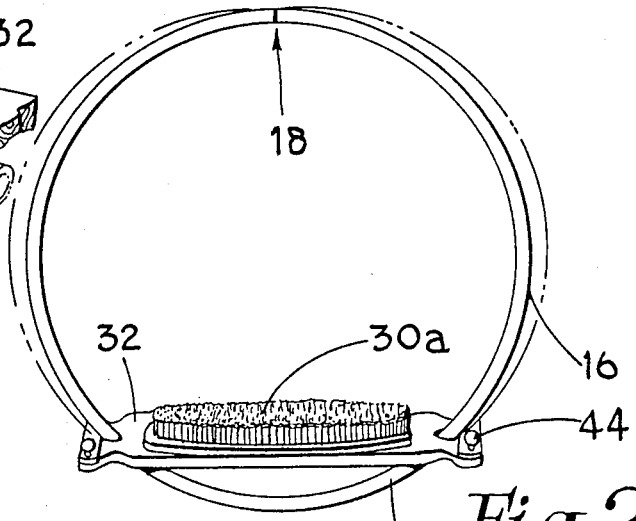
FIG. 2 is a perspective view of the invention with one form of body applicator assembly in place.
Figure 4:
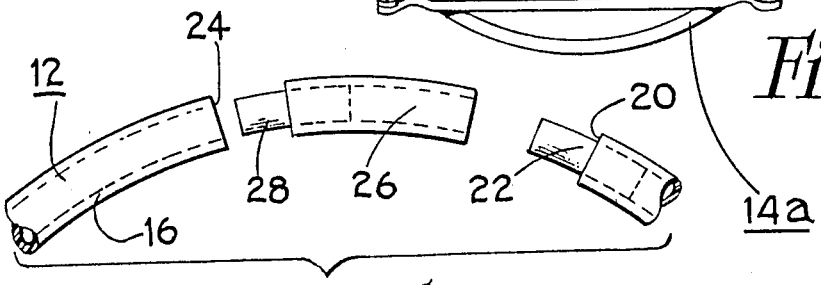
FIG. 4 is a fragmentary exploded perspective view illustrating the insertable segment.
Figure 5:
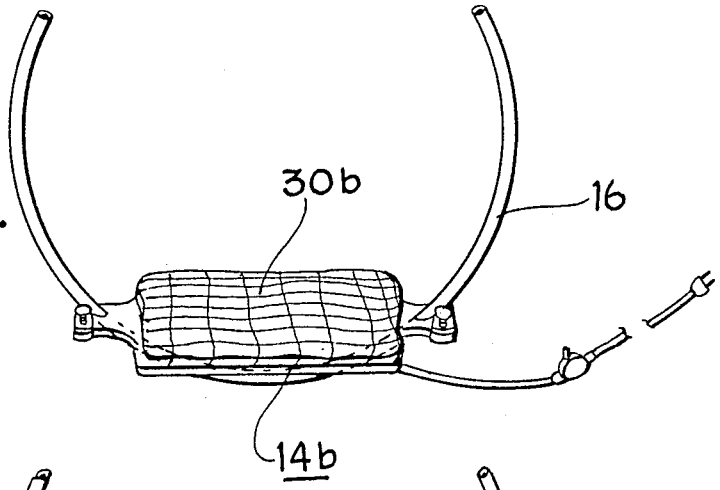
FIGS. 5, 6, and 7 are elevation views illustrating embodiments of applicator assemblies including, respectively, a heating pad, a massager and an absorbent pad for applying creams and lotions.
Figure 6:
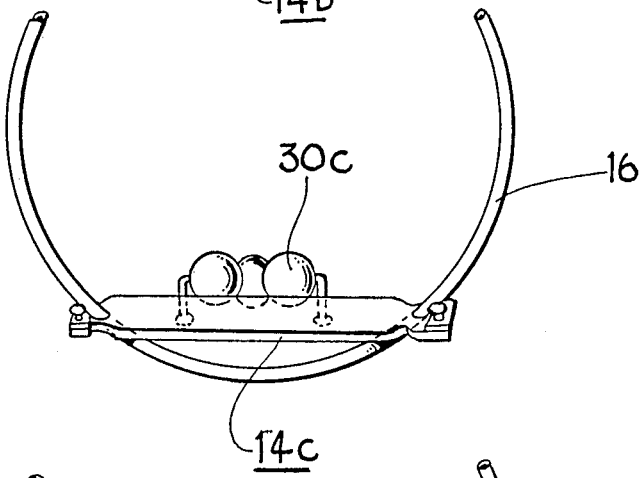
Figure 7:
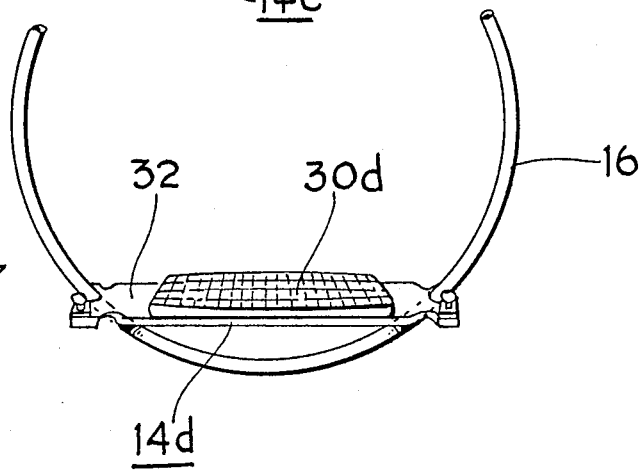

An applicator assembly 14, exemplified in FIGS. 1 and 2 by scrubbing brush assembly **14*a*, includes a scrubbing brush 30*a* secured to a backing element 32. The backing element 32 comprises a flat, rigid element of wood, plastic or other suitable or desirable rigid material; it includes slots 34 or other suitable means at each of its ends for removable but firm engagement with the frame element 16. At the open end of each of the slots 34 on each side thereof apertures 38 are provided extending through the backing element 32. On one side of each of the slots 34 a strap element 40 constituting clamping means is pivotally secured on an axis defined by a rivet or stud 42 extending through an aperture 38. When the applicator assembly 14 is placed in operative position extending chordally across frame element 16 with slots 34 engaging the frame element 16, the straps 40 may be pivotted to a position spanning the slots 34 to retain the applicator assembly 14 in position. The other aperture 38 may be threaded and a thumb screw 44 inserted through the strap 40 to retain the strap in position. A bolt and wing nut or other suitable securing means may be employed rather than a thumb screw if desired. In lieu of a scrubbing brush 30*a* the applicator assembly may include other and diverse types of appliances for alternative uses. Examples include a heating pad 30*b*, a massaging device 30*c* or an absorbent pad 30*d* for applying body creams, lotions or medicinal materials as illustrated in FIGS. 5, 6, and 7** respectively. Other and different types of applicators not specifically illustrated may also be employed.

In use the selected applicator assembly 14 is mounted on the frame element 16. Thereupon the frame assembly 12 is positioned to encircle the body as shown in FIG. 1. The plane of the frame element 16 may be positioned horizontally as shown in dotted lines at A in FIG. 1 or in any suitable angular position as shown at B necessary to conveniently reach the body area to which the applicator is to be applied. The frame assembly 12 may be grasped at any comfortable or convenient locations on its periphery and manipulated to either rotate the applicator assembly 16 or to move it linearly depending upon the most appropriate means to apply the desired treatment. The user's hands may be moved to different grasping positions on the periphery of the frame element to achieve the most comfortable and efficient position. When the treatment or application is completed the user can slip the frame assembly from the encircling position, loosen the thumb screw 44 and remove the applicator assembly 14 and replace it with a different applicator assembly as required and resume treatment. If the person using the apparatus finds it to be inconveniently undersized he or she can readily separate the ends 20, 24 by exerting a slight pull in opposite directions at the junction 18. The segment 26 may then be inserted to enlarge the periphery.

Although a certain specific embodiment of the invention has been shown and described for the purpose of illustration it will be apparent that various modifications and other embodiments are possible within the scope of the invention. For example, in accordance with the broader aspects of the invention the shape of the frame assembly may be other than circular. Although in the preferred form of the invention the frame is a closed circular loop which totally encircles the body, in accordance with the broader aspects of the invention the frame may be open; it may substantially but not totally encircle the body. The cross section of the frame may be other than tubular and circular. Other and different materials than those described may be employed as well as other and different types of body treatment applicators. It is to be understood, therefore, that the invention is not limited to the specific arrangement shown but in its broadest aspects it includes all equivalent embodiments and modifications which come within the scope of the invention.

What we claim is:

1. Self treatment body care applicator apparatus for accessing and applying treatment to the dorsal area of the human torso comprising a circular frame element of nonextensible, resiliently flexible, tubular plastic material for circumscribing a portion of a human torso and a set of diverse interchangable applicator assemblies, each being secured to said frame element separately and individually usable, each applicator assembly of said set comprising an elongate, rigid, planar backing element having an open ended slot at each end extending parallel to the longitudinal central axis of said backing element, said backing element being readily and firmly engagable with and quickly and readily removable from said frame at circumferentially spaced points, a slot restricting means located at each end of said backing element, said slot restricting means selectively blocking the open ends of said slots so as to secure said applicator assembly to said frame element, each backing element of said set having a different type of body care appliance secured to a major surface thereof whereby each applicator assembly is readily securable to and readily removable from said frame element for performing successive steps in a body care routine.

2. Self treatment body care applicator apparatus according to claim 1 wherein said types of body care appliances include one or more of a body scrubbing brush, an absorbent pad, a massaging device and a heating pad.

3. Self-treatment body care applicator apparatus for accessing and applying treatment to the dorsal area of the human torso comprising a closed, circular frame element of tubular, flexible plastic material, an applicator assembly positionable to chordally straddle said frame element including a backing element and a body care appliance affixed thereto, said backing element having a slot at each end, said slots being engageable with said frame element, a strap pivotally mounted adjacent an open end of at least one of said slots on one side thereof and moveable from a first position straddling said slot whereby said slot is releasably restrained against disengagement from said frame element to a second position opening said slot to allow disengagement of said backing element from said frame element, releasable securing means for retaining said strap in said first position whereby said applicator assembly is releasably retained against displacement from said frame element, said frame element having a separable junction and a segment releasably retainable between the ends ends of said separable junction whereby said frame element can be enlarged to accomodate larger bodies.

4. Body care applicator apparatus according to claim 3 wherein said appliance is a scrubbing brush.

5. Body care applicator apparatus according to claim 3 wherein said appliance is a massaging device.

6. Body care applicator apparatus according to claim 3 wherein said appliance is a heating pad.

7. Body care applicator apparatus according to claim 3 wherein said appliance is an absorbent pad.

* * * * *